United States Patent [19]

Steifensand

[11] Patent Number: 4,682,815

[45] Date of Patent: Jul. 28, 1987

[54] CHAIR

[76] Inventor: F. Martin Steifensand, Sperbersloher Str. 124, D-8501 Wendelstein, Fed. Rep. of Germany

[21] Appl. No.: 839,156

[22] Filed: Mar. 13, 1986

[30] Foreign Application Priority Data

Apr. 16, 1985 [DE] Fed. Rep. of Germany ... 8511034[U]

[51] Int. Cl.[4] ..... A47C 3/00

[52] U.S. Cl. ..... 297/300; 297/83; 297/313

[58] Field of Search ..... 297/300, 354, 313, 316, 297/83

[56] References Cited

U.S. PATENT DOCUMENTS

| | | | |
|---|---|---|---|
| 4,200,332 | 4/1980 | Brauking | 297/300 |
| 4,411,469 | 10/1983 | Drabert et al. | 297/300 |
| 4,456,297 | 1/1984 | Pietschmann | 297/83 X |

FOREIGN PATENT DOCUMENTS

| | | | |
|---|---|---|---|
| 0085670 | of 1985 | European Pat. Off. . | |
| 7711865 | 8/1977 | Fed. Rep. of Germany . | |
| 2843058 | 4/1980 | Fed. Rep. of Germany | 297/300 |

*Primary Examiner*—James T. McCall

*Attorney, Agent, or Firm*—Bacon & Thomas

[57] ABSTRACT

A chair comprises a pedestal base and a support member (6) mounted on the base. A seat carrier (5) is connected at its forward end portion with the member (6) to be pivotable relative thereto about a first horizontal axis (7), which is fixed relative to both the member and the carrier. A backrest carrier (11) is similarly connected with the member (6) to be pivotable relative thereto about a second horizontal axis (17) and additionally with the seat carrier (5) at its rearward end portion to be pivotable relative thereto about a third axis (23), this axis being movable relative to the seat carrier (5). The carriers (5, 11) are pivotable together relative to the member (6) in the same rotational sense with the backrest carrier (11) traversing a greater pivot angle than the seat carrier (5). A spring unit (32) acts between the member (6) and the backrest carrier (11) to bias the backrest carrier in an upward and forward direction. The pivot axes are parallel to each other and are arranged in or closely adjacent to a single plane in all pivot positions of the carriers, with the result that, during pivotation relative to the member (6), the carriers (5, 11) describe almost congruent circular arcs at the third axis (23).

12 Claims, 3 Drawing Figures

CHAIR

BACKGROUND OF THE INVENTION

The present invention relates to a chair, especially an office chair or easy chair.

In EP-PS No. 00 85 670 there is disclosed a chair in which a point of articulation of a backrest carrier to a support block of a base pedestal is disposed outside a line connecting the point of articulation of a seat carrier to the block and the point of articulation of the seat carrier to the backrest carrier. This has the consequence that, during pivotation out of a work position, in which the rearward region of the seat carrier is raised furthest and the backrest carrier with backrest is pivoted furthest forward, into a rest position, in which the rearward region of the seat carrier is pivoted furthest downwardly and the upper region of the backrest carrier furthest rearwardly, the seat carrier must perform a relatively large displacement relative to either the block or the backrest carrier. This requires an unintended rearward redisposition of weight of the user during pivotal movement into the rest position. Consequently a sliding hinge, which forms the forward articulation point between the seat carrier and block, is subjected to a high degree of friction, because this hinge must take up by far the larger part of the weight of the user. Moreover, in some circumstances there is the danger of tipping over. The so-called "shirt pull-out effect", which then arises and is described in EP-PS No. 00 85 670 in relation to FIGS. 1 and 2 thereof and is exerted by the backrest on the back of the user during rearward pivotation, then has to be eliminated by a relatively expensive displacement of the backrest relative to the backrest carrier.

DE-GM No. 77 11 865 there is disclosed a chair which, as in the case of EP-PS No. 00 85 670, provides a synchronously coupled displacement of the seat carrier and backrest carrier, inclusive of force store (gas spring) for resetting into a predetermined limit setting (work position). However, the force store is arranged behind the forwardly directed surface of the backrest in order to improve the aesthetics of the structure. However, this is unsuitable for the preferred purpose of use as an office or easy chair. The arrangement of the gas spring in the backrest requires that this be very thick, but an office or easy chair has only a relatively short backrest with a rod-shaped backrest carrier. Moreover, the angle of engagement of the upper part of the gas spring at the backrest carrier is so small that a disadvantageous force transmission ratio results. Finally, a hinge connection with two articulation points is provided for the connection of the rearward region of the seat carrier with the backrest carrier. This is not only expensive to produce, but also susceptible to faults, and obliges a spacing between the rearward region of the seat carrier and the part of the backrest carrier disposed therebelow, whereby the space required by the seat with seat carrier, backrest carrier and pedestal block, is relatively great in height. Some compensation is provided by redisposition of the gas spring into the backrest. If, however, the gas spring were to be disposed underneath the seat carrier, then it would have to be relatively low and would no longer be laterally covered by the seat carrier, backrest carrier or pedestal block. There is thus the danger of snagging articles of clothing and/or injury to fingers which have access to projecting and moving parts. Finally, such a chair has a relatively bulk appearance.

There is thus scope for improvement of such chairs so that on pivotation of the seat carrier and backrest carrier the deviations, which effect their displacement relative to each other, in the pivot arcs of the carriers relative to a support member are relatively small.

SUMMARY OF THE INVENTION

According to the present invention there is provided a chair comprising a pedestal base, a support member mounted on the base, a seat carrier connected at a forward end portion thereof with the member to be pivotable relative thereto about a first horizontal axis which is fixed relative to both the member and the carrier, a backrest carrier connected with the member to be pivotable relative thereto about a second horizontal axis and with the seat carrier at a rearward end portion thereof to be pivotable relative thereto about a third axis which is movable relative to one of the carriers, the carriers being pivotable together relative to the member in the same rotational sense with the backrest carrier traversing a greater pivot angle than the seat carrier, and force storage means acting between the member and the backrest carrier to bias the backrest carrier in an upward and forward direction, the axes being parallel to each other and so arranged in or closely adjacent to a single plane in all pivot positions of the carriers that during pivotation relative to the member the carriers describe almost congruent circular arcs at the third axis.

In this chair, in spite of differences in the length of the respective pivot radii or arcs of the carriers, the relative displacements at the connection point between the carriers are relatively small so that, for example, an elongate hole can be provided to receive a pivot pin defining the third axis, the length of the hole being only slightly greater than the diameter of the pin. This relative displacement has no part in the redisposition of the weight of a person sitting on a seat carried by the seat carrier. The main weight falls on the forward connection between seat carrier and support member, which is fixed, i.e. there is no displacement of the first axis relative to the seat carrier or support member. Thus, this forward connection point is robust and able to accept the arising forces. Rattling or friction-induced noise does not occur at this location. The construction of this forward connection point with a fixed axis and not a sliding axis is also important for the reason that this point may, in some chair constructions, lie in the proximity of a vertical column of the pedestal base and therefore carry the main weight of the user as well as, during rocking of the seat carrier rearwardly/downwardly, withstand this rotary movement. The rearward connection between seat carrier and backrest carrier is thereagainst relatively lightly loaded.

The arrangement of the gas spring in the backrest according to German (Federal Republic) Utility Model No. 77 11 865 can be avoided, nor is it necessary to use a hinge connector between seat carrier and backrest carrier of the kind described in the German (Federal Republic) Utility Model.

Preferably, the seat carrier has a U-shaped cross-section, which can be provided with appropriate bores, passages and so forth.

BRIEF DESCRIPTION OF THE DRAWINGS

An embodiment of the present invention will now be more particularly described by way of example and with reference to the accompanying drawings, in which.

DETAILED DESCRIPTION OF A PREFERRED EMBODIMENT

Figure 1:
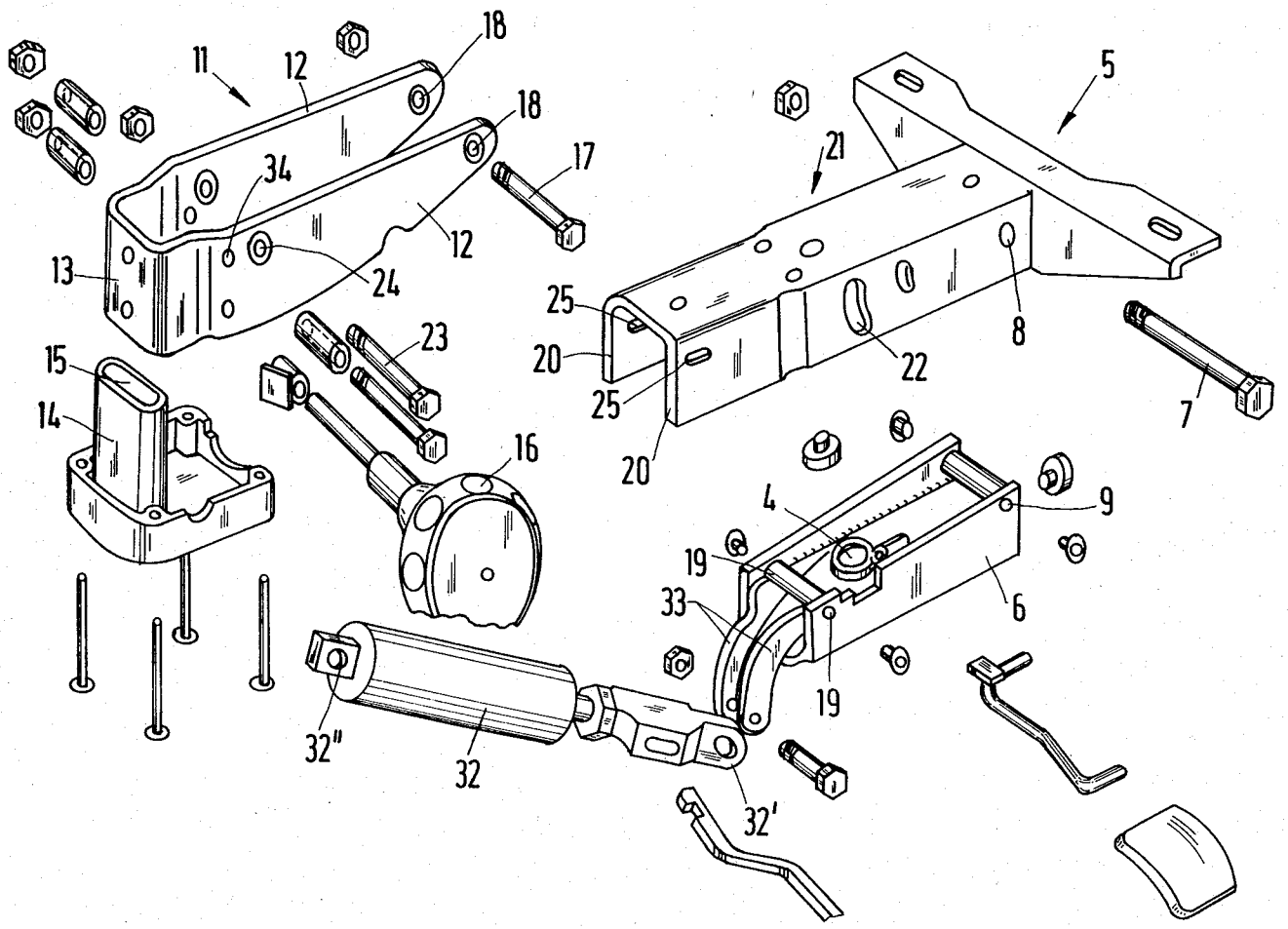
FIG. 1 is an exploded view of part of a chair embodying the present invention.

Referring now to the drawings, there is shown part of a chair comprising a pedestal base 1 with a carrier column 2 (this can be a gas spring) having a conical plug or pin 3 which is plugged into a bore 4 of a support block 6 and fastened therin. A seat carrier 5, which is approximately T-shaped in plan view, is pivotably connected to a block member 6 by means of a first pivot pin 7 (equal to a first pivot axis 7), whrerein the pin 7 passes through bores 8 in limbs 20 of a portion 21 of the seat carrier 5 and bores 9 in corresponding limbs of the block 6. This first hinge arrangement provided in the forward region of the seat carrier and of the block is fixed, i.e. has no play. By "forward" is understood that region of the seat carrier which is forward in the viewing direction of a user sitting on the chair, while the "rearward" region of the seat carrier adjoins a backrest part of the chair. It is evident that the pin 7 extends horizontally and transversely to the viewing direction of the user.

Figure 2:
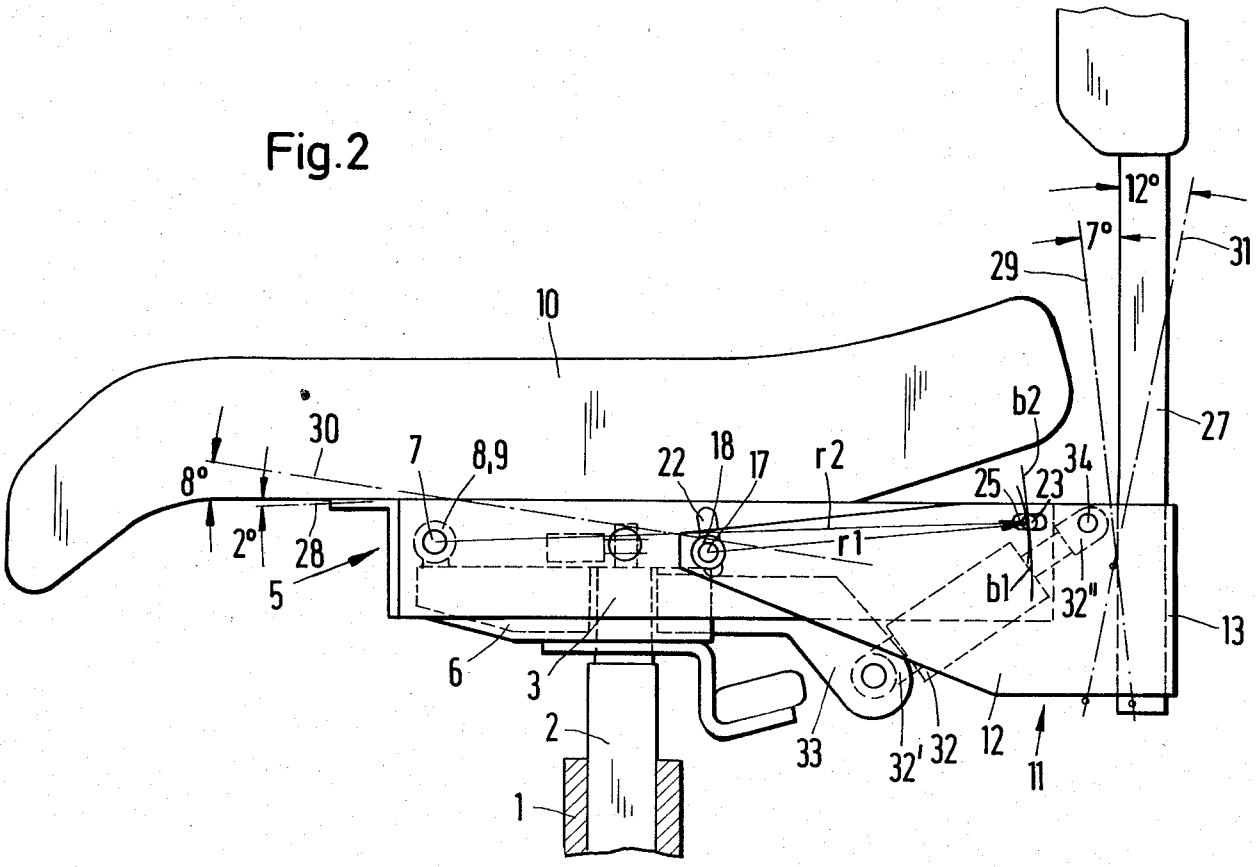
FIG. 2 is a partly sectioned side elevation of the chair of FIG. 1, in an assembled state.

The chair also comprises a backrest carrier 11, which consists of two plates or flaps 12 joined by a rearward connecting web 13 and into which a mounting 14 for supporting a backrest is inserted from below. The mounting 14 is provided with an opening 15 into which the backrest 27 is plugged from above, as shown in FIG. 2. The desired height position of the backrest relative to the mounting 14 can be adjusted by way of a screwable adjusting means 16, which is manually operable. The backrest carrier 11 and thereby the backrest are connected by way of a second pivot pin 17 (equal to a second pivot axis 17) to the block 6, the pin 17 passing through holes 18 in the plates 12 and holes 19 in both limbs of the block 6. Since the two limbs 20 of the seat carrier portion 21, which is U-shaped in cross section, in the assembled state of the chair engage over the block 6 and the two plates 12 of the backrest carrier 11 furthermore rest against the external surfaces of the afore-mentioned limbs 20, a passage 22 is provided in each of the limbs 20 to accommodate the second pivot pin 17 and permit pivotal movement of the seat carrier 5 about the first pin 7 The passages 22 are not, however, exposed to any pivotal or seating forces.

A third pivot pin 23 (equal to a third pivot axis 23) passes through holes 24 in the straps 12 of the backrest carrier 11 and also through elongate holes 25 in the limbs 20 of the seat carrier. The third axis 23 is disposed at the rearward end of the seat carrier 5, i.e. closely to the backrest 27.

Figure 3:
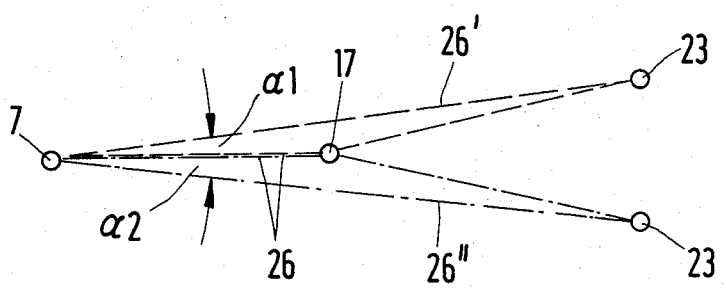
FIG. 3 is a diagram showing the relative disposition of three pivot axes of the chair in different pivotal settings.

The three pivot pins or axes 7, 17 and 23 are parallel to each other and lie almost in a single plane. The diagram of FIG. 3 shows the uppermost and lowermost positions of the third axis 23. The uppermost position corresponds to a work position, in which seat carrier 5 and backrest carrier 11 are pivoted upwardly and forwardly. The lowermost position of the axis 23 corresponds to a rest position, in which seat carrier 5 and backrest carrier 11 have been pivoted downwardly and rearwardly as far as possible. The line connecting the axes 7 and 23 is referenced 26' in the work position and 26'' in the rest position. During transition from one such position to the other, the line connecting the axes 7 and 23 passes the second axis 17 and thereby comes into congruency with a notional connecting line 26 between the first and second axes 7 and 17. Thus, in the two end pivotal positions, the line 26' (illustrated in dashed lines) is disposed on one side of the line 26, and the line 26'' (illustrated in chain-dotted lines) is disposed on the other side of the line 26. The angle alpha 1 between the lines 26 and 26' and the angle alpha 2 between the lines 26 and 26'' are each relatively small, preferably 4 to 6°, in this case 5°. By this arrangement of three axes 7, 17 and 23, the circular arc b1 of the radius r1 between the axes 17 and 23 in the pivotal range deviates only slightly from the circular arc b2 of the radius r2 between the axes 7 and 23. This would be the case when, for example, the axis 17 lies substantially lower compared with the axes 7 and 23 than is the case for the present invention. Thereby, the elongate holes 25 can be relatively short, for example about 10 millimeters for a diameter of the pin 17 of about 8 millimeters.

FIG. 2 shows, in solid lines, the seat carrier 5 in the horizontal setting and the associated position of backrest carrier 11 and backrest 27. The extreme forward or work position is designated by chain-dotted line 28 at the seat carrier and 29 at the backrest, whilst the respective extreme rearward or rest position of the seat carrier and backrest is designated by chain-dotted lines 30 and 31, respectively. In that case, the seat carrier has passed through a pivot angle of about 10° (corresponding to the sum of the angles alpha 1 and alpha 2) between the two extreme settings and the backrest an angle of about 19°, i.e. the backrest passes through about twice the angular range as the seat carrier in both pivotal directions. The pivotal movement from the work position (28, 29) to the rest position (30, 31) can be affected by the body weight of the user, whereas the pivotal movement in the reverse direction is effected or assisted by a force store in the form of a gas spring 32. This gas spring is arranged, for example in known manner (see European Patent Specification No. 00 85 670) underneath the seat carrier. Its lowed end 32' bears against a rearwardly directed arm 33 of the block 6, while its upper end 32'' is articulated at 34 to the backrest carrier 11, namely at holes 34 thereof. The holes 24 and 34 lie very closely beside each other.

What is claimed is:

1. A chair comprising:

(a) a pedestal base;

(b) a support member mounted on the pedestal base;

(c) a seat carrier connected at a forward end portion thereof to the support member for pivotal movement about a stationary first horizontal axis;

(d) a backrest carrier connected to the support member for pivotal movement about a second horizontal axis, and to a rearward end portion of the seat carrier for pivotal movement about a third horizontal axis;

(e) the seat and backrest carriers being pivotable together relative to the support member within a pivotal range and in a direction between a work position and a rest position, wherein the backrest carrier traverses a greater pivot angle between the work and rest positions than the seat carrier;

(f) force storage means disposed between the support member and the backrest carrier for biasing the backrest carrier in an upward and forward direction towards the work position; and (g) the first, second and third horizontal pivot axes being disposed in parallel to each other and substantially within a single plane, whereby during pivotal movement of the seat and backrest carriers relative to the support member within the pivotal range, a first radius described between the second and third horizontal axes and a second radius described between the first and third horizontal axes define substantially congruent circular arcs at the third horizontal axis.

2. The chair of claim 1 wherein when the seat and backrest carriers are disposed in a work position, a first line connecting the first and second horizontal axes is disposed below a second line connecting the first and third horizontal axes, and when the seat and backrest carriers are disposed in the rest position, the first line is disposed above the second line.

3. The chair of claim 2 wherein in each of the work and rest positions, the first and second lines define a relative angle therebetween.

4. The chair of claim 3 wherein the relative angle is approximately 4°–6°.

5. The chair of claim 1 wherein the backrest carrier and the seat carrier are each disposed for traversing a pivot angle, with the pivot angle of the backrest carrier being substantially twice the pivot angle of the seat carrier.

6. The chair of claim 1 wherein the force storage means includes a gas-damped spring unit disposed substantially under the seat carrier.

7. The chair of claim 6 wherein the support member includes a rearwardly extending arm and the spring unit includes a lower end connected to the arm.

8. The chair of claim 6 wherein the spring unit includes an upper end connected to the backrest carrier at a point adjacent the third horizontal axis.

9. The chair of claim 8 wherein the spring unit is connected to the backrest carrier at a point located rearwardly of the third horizontal axis.

10. The chair of claim 1 wherein the backrest carrier includes two spaced plates, and the seat carrier is disposed between the plates.

11. The chair of claim 10 wherein the seat carrier is of a substantially U-shaped cross-sectional configuration.

12. The chair of claim 10 wherein the seat carrier is provided with passage means, the second horizontal axis is defined by an axle pin, and the axle pin being disposed through the passage means for movement therin.

* * * * *